US006753051B1

(12) United States Patent
Landry-Coltrain et al.

(10) Patent No.: US 6,753,051 B1
(45) Date of Patent: Jun. 22, 2004

(54) INK RECORDING ELEMENT UTILIZING WRINKLED PARTICLES

(75) Inventors: Christine J. Landry-Coltrain, Fairport, NY (US); Jeffrey W. Leon, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 129 days.

(21) Appl. No.: 10/208,220

(22) Filed: Jul. 30, 2002

(51) Int. Cl.[7] ..... B41M 5/40

(52) U.S. Cl. ..... 428/32.36; 428/32.21; 428/32.25; 428/32.27; 428/32.28; 428/32.37

(58) Field of Search ..... 428/32.21, 32.25, 428/32.27, 32.28, 32.36, 32.37; 347/105

(56) References Cited

U.S. PATENT DOCUMENTS

| | | | | |
|---|---|---|---|---|
| 5,559,202 A | | 9/1996 | Yoshikawa | 526/207 |
| 5,851,651 A | | 12/1998 | Chao | 428/327 |
| 6,114,020 A | * | 9/2000 | Misuda et al. | 428/32.35 |
| 6,357,871 B1 | * | 3/2002 | Ashida et al. | 347/106 |
| 6,497,480 B1 | * | 12/2002 | Wexler | 347/102 |

FOREIGN PATENT DOCUMENTS

| | | | |
|---|---|---|---|
| WO | WO 92/16565 | 10/1992 | C08F/2/18 |
| WO | WO 93/19099 | 9/1993 | C08F/2/18 |

OTHER PUBLICATIONS

Sumalee Tawonsree et al, Journal of Polymer Science: Part A: Polymer Chemistry, vol. 38, 2000, pp. 4038–4056.

U.S. application Ser. No. 10208344 of Leon et al, "Wrinkled Polyester Particles" (Docket 83814LMB).

* cited by examiner

*Primary Examiner*—B. Shewareged
(74) *Attorney, Agent, or Firm*—Lynne M. Blank

(57) ABSTRACT

The present invention comprises an ink recording element comprising a support having thereon at least one ink receiving layer, the layer comprising wrinkled particles. The present invention also includes a method of forming a print comprising providing an ink recording element comprising at least one ink receiving layer capable of accepting an ink image, the layer comprising wrinkled particles and printing on the ink recording element utilizing a printer.

60 Claims, No Drawings

INK RECORDING ELEMENT UTILIZING WRINKLED PARTICLES

CROSS REFERENCE TO RELATED APPLICATIONS

Reference is made to commonly assigned, co-pending U.S. patent applications: Ser. No. 10/208,344 by Leon et al., filed of even date herewith entitled "Wrinkled Polyester Particles".

FIELD OF THE INVENTION

The present invention relates to ink recording elements utilizing wrinkled particles

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An inkjet recording element typically comprises a support having on at least one surface thereof an ink-receiving or image-forming layer and includes those intended for reflection viewing, which have an opaque support, and those intended for viewing by transmitted light, which have a transparent support.

An inkjet recording element that simultaneously provides an almost instantaneous ink dry time and good image quality is desirable. However, given the wide range of ink compositions and ink volumes that a recording element needs to accommodate, these requirements of inkjet recording media are difficult to achieve simultaneously.

Inkjet recording elements are known that employ porous or non-porous single layer or multilayer coatings that act as suitable ink receiving layers on one or both sides of a porous or non-porous support. Recording elements that use non-porous coatings typically have good image quality and stability but exhibit poor ink dry time. Recording elements that use porous coatings typically contain colloidal particulates and have poorer image stability but exhibit superior dry times.

While a wide variety of different types of porous image recording elements for use with inkjet printing are known, there are many unsolved problems in the art and many deficiencies in the known products which have severely limited their commercial usefulness. A major challenge in the design of a porous image-recording layer is to be able to obtain good quality, crack-free coatings. Inkjet prints, prepared by printing onto inkjet recording elements, are subject to environmental degradation. They are especially vulnerable to light fade and fade resulting from gaseous impurities in the air, such as ozone and nitrogen oxides. Highly swellable hydrophilic layers can take an undesirably long time to dry, slowing printing speed. Porous layers speed the absorption of the ink vehicle, but often suffer from insufficient gloss and severe dye fade. Porous layers are also difficult to coat without cracking.

Irregularly shaped microparticles are known in the art, but they are badly suited for specific imaging applications due to either their size or composition or their inherent difficulty in preparation. WO 92/1655 and WO 93/19099 report crosslinked, wrinkled particles comprised of ethylenically unsaturated carboxylic acid-containing monomers. These particles, however, are large in size (>75 micrometers) and thus are unsuitable for use in thin coatings. In addition, the monomeric composition is chemically aggressive and will hasten the fade of guest dyes and colorants, thus making these particles unsuitable for certain imaging applications. Finally, the liquid uptake of these materials is extremely large. The particles increase dramatically in size upon absorbing liquids. Thus, coatings comprised of such superabsorbants will lose wet cohesion due to the large dimensional changes of the particles upon absorption of liquids. Bowl-shaped, crosslinked vinyl microparticles are reported in U.S. Pat. No. 5,559,202. The chemical composition of these particles, however, does not afford stability advantages to adsorbed dyes and colorants, thus making these particles unsuitable for use in inkjet receiver media. Wrinkled and irregularly shaped particles comprising methacrylate monomers are disclosed in Journal of Polymer Science Part A: Polymer Chemistry, Vol. 38 p. 4038–4056 (2000). Similarly, the chemical composition of these particles does not afford stability advantages to adsorbed dyes and colorants, thus making these particles unsuitable for use in inkjet receiver media.

There is a need to provide an inkjet recording element, which will provide improved ink uptake speed. In addition, theme remains a need to provide an inkjet recording element having a receiving layer that when printed upon has an excellent image quality and stability.

SUMMARY OF THE INVENTION

The present invention comprises an ink recording element comprising a support having thereon at least one ink receiving layer, the layer comprising wrinkled particles. In another embodiment, the present invention comprises an ink recording element comprising a support having thereon at least one ink receiving layer, the layer comprising wrinkled polyester-containing particles. The present invention also includes a method of forming a print comprising providing an ink recording element comprising at least one ink receiving layer capable of accepting an ink image, the layer comprising wrinkled particles and printing on the ink recording element utilizing a printer.

Using the invention, a recording element is obtained which will provide improved ink uptake speed, and when printed upon, has an excellent image quality and stability.

DETAILED DESCRIPTION OF THE INVENTION

The wrinkled particles of the present invention may be comprised of any polymeric material. The wrinkled particles will have a surface with at least one wrinkle. For purposes of the present invention, a wrinkle may comprise folds, ridges, crevices, channels or combinations thereof. The mean distance between the crests of the folds, ridges, crevices or channels may vary from 0.02 to 2 micrometers. Preferably, the mean distance may be between 0.04 and 0.4 micrometers. These "wrinkled" particles are distinct from "porous" particles in that the folds, ridges, crevices, channels or combinations thereof are present on the surface of the particle and do not form continuous pathways through the particle's interior. These particles may have any shape, including spherical or bowl-shapes. In the case that the particle has only one wrinkle, then the particle can be said to be "bowl-shaped." Typical wrinkled particles well known to those skilled in the art are discussed and illustrated in U.S.

Pat. No. 5,559,202, W/O 92/16565, W/O 93/19099, and Ser. No. 10/208,344 by Leon et al., (Docket 83814) filed of even date herewith entitled "Wrinkled Polyester Particles".

The wrinkled particles of this invention are preferably readily dispersible in water, in water-miscible organic solvents, and in combinations thereof. They may be stored as dispersions or the solvents can be removed to yield a dry material, which can be readily redispersed. The wrinkled particles may be stabilized by surfactants, colloidal inbrganics, protective colloids, or combinations thereof, which may be reversibly adsorbed, affixed or chemically bound to the surface. Alternately, the particles may be stabilized by functionalities, which are covalently bound within the monomeric and polymeric components, which are reacted to form the particles.

The wrinkled polymeric particles of the present invention may be made by any method known to those skilled in the art. Most known wrinkled particles are synthesized via a suspension polymerization process involving one or more unifunctional and one or more multifunctional monomers in the presence of an inert liquid which is present in the same phase as the monomers and which solvates, swells or plasticizes the polymerization phase. The suspension polymerization may be of the conventional oil-in-water or inverse water-in-oil type. The polymerization mechanism may be an addition polymerization or a polycondensation. The inert liquid may be water or a water-miscible solvent, in an inverse suspension system, or any of the water-immiscible organic solvents listed below, in a conventional suspension system. In certain cases, the monomeric mixture itself may serve as a swelling agent for the polymeric product and no added inert liquid will be needed. In other cases, the wrinkles are induced during a suspension polymerization by differential rates of polymerization between the interior and the shell of the individual droplet of the discontinuous phase of the suspension, causing stresses to build within the individual particles. In still other cases, the removal of the inert liquid via evaporation or the thermal contraction of the particle ray induce the collapse and deformation.

Exemplary ethylenically unsaturated monomers, which may be used to prepare wrinkled particles include, but are not limited to, ethylenically unsaturated substituted and unsubstituted materials, amides such as acrylamide, methacrylamide, and fumaramidc as well as their N-substituted derivatives, ethylenically unsaturated carboxylic acids such as acrylic, methacrylic, and crotonic acids and their esters and salts, polycarboxylic acids, such as maleic acid and fumaric acids and itaconic acid, styrenics, vinyl amines such as vinyl pyridine and vinyl morpholine, and diallyl amines. Other suitable monomers are well known to those skilled in the art as discussed in U.S. Pat. No. 4,708,997. In addition, unifunctional and polyfunctional monomers, which may be used to produce suitable wrinkled particles, are discussed below.

In a preferred embodiment of the present invention, the wrinkled particles comprise wrinkled polyester-containing particles comprising the hybrid copolymerization product of an unsaturated precursor polyester and one or more monomers, which contain ethylenic unsaturation. A precursor polyester is a polyester containing unsaturated groups, which is used in turn to make wrinkled polyester particles. The wrinkled polyester-ontaining particles useful for this invention are described in Ser. No. 10/208,314 by Leon et al., (Docket 83814) filed of even date herewith entitled "Wrinkled Polyester Particles".

In a preferred embodiment, the wrinkled particles, preferably comprising polyester, will contain ionic groups. The ionic groups may be anionic, such as carboxylate, sulfonate, sulfate, or thiosulfate, or cationic, such as ammonium, phosphonium, orsulfonium. The ionic groups will preferably be covalently bound to the particle and will be present in such quantity as to give an ionic group equivalent weight of between 1,000 and 500,000 grams of particle per mole of ionic unit. Preferably, the ionic group equivalent weight of between 2,400 and 50,000 grams of particle per mole of ionic unit. These ionic units can be introduced into the particle by being present on the particle's parent components (monomers or precursor polyester) or they can be introduced to the particle by chemical modification of the particle after the particle has been synthesized. As an example of the former case, if the precursor polyester contains a sulfonated monomer or repeating unit (such as sulfoisophthalate), then this unit will be present in the particle. As an example of the latter case, if chloromethyl styrene is one of the monomers used in the preparation of the particle, then reaction of the particle with a tertiary amine will yield a particle functionalized with quaternary ammonium ions.

The precursor materials, preferably polyesters, which may be used to form the wrinkled polyester particles of this invention are branched or unbranched, contain chemical unsaturation, and are either soluble in water-immiscible organic solvents or in water. Optionally, the precursor polyester may be self-emulsifying in water or amphiphilic or surfactant-like in character. The precursor polyesters may have any glass transition temperature, provided it fulfills the solubility requirements. Preferably, the number average molecular weight (Mn) is between 1,000 and 30,000 gm/mole.

As is well known in the art, polyesters are condensation products of polybasic acids or of corresponding acid equivalent derivatives such as esters, anhydrides or acid chlorides and polyhydiic alcohols. It will be known that whenever "diacids" or "polyacids" are referred to in this document, that corresponding acid equivalent derivatives such as esters, anhydrides or acid chlorides are also included by reference. Polymerizable unsaturation may be introduced into the molecule by the selection of a polybasic acid or polyhydric alcohol, which contains $\alpha,\beta$-ethylenic unsaturation. For example, a polyhydric alcohol, which contains pendant unsaturation, is glycerol monomethacrylate. In most cases, however, the unsaturation will be contained within the polybasic acid unit. Optionally, one or more additional polyacids common in the art of polycondensation may be used in addition to the unsaturated polyacid. These ethylenically unsaturated polyacids include, but are not necessarily limited to maleic, fumaric, itaconic, phenylenediacrylic, citraconic and mesaconic acid. Other, additional polyacids, which do not contain chemical unsaturation and can be used in polyesters are described in WO 01/00703 and are incorporated herein by reference. These diacids can include, but are not necessarily limited to malonic, succinic, glutaric, adipic, pimelic, azelaic, and sebacic acids, phthalic, isophthalic, terephthalic, tetrachlorophthalic, tetrahydrophthalic, trimellitic, trimesic, isomers of naphthalenedicarboxylic acid, chlorendic acid, trimellitic acid, trimesic acid, and pyromellitic acid.

Ethylenically unsaturated groups can also be introduced into the precursor polyester by synthetic modification. For example, a polyester with a high alcohol number can be reacted with an anhydride or acid chloride of acrylic acid or methacrylic acid in order to introduce ethylenically unsaturated units.

Precursor polyesters that are suitable for this invention can furthermore be comprised of any of a wide variety of polyhydric alcohols, which are well known in the art of polycondensation and may be aliphatic, alicyclic, or aralkyl. A description of suitable polyhydric alcohols is given in WO 01/00703 and is incorporated herein by reference. These alcohols can include, but are not necessarily limited to ethylene glycol, 1,3-propylene glycol, 1,6-hexanediol, 1,10-decanediol, 1,4-cyclohexanedimethanol, 1,4-cyclohexanediol, hydroquinone bis (hydroxyethyl) ether, diethylene glycol, neopentyl glycol, bisphenols such as bisphenol A, ethylene oxide and propylene oxide adducts of bisphenol A, pentaerythritol, trimethylolpropane, and polyester polyols, such as that obtained by the ring-opening polymerization of ϵ-caprolactone. Additionally, A-B type polycondensation monomers which contain both hydroxyl and acid derivative functions can be used as well as monoacids and monoalcohols.

In one embodiment of this invention, precursor polyesters, which are water-soluble, surfactant-like, or self-emulsifying and additionally contain chemical unsaturation may be utilized. Water-soluble, surfactant-like, and self-emulsifying polyesters are well known in the art and will contain one or more type of hydrophilic chemical group, functionality, or monomer, such as carboxylate, ammonium, quaternary ammonium, sulfonate, sulfate, sulfonium, phosphonium, irrinosulfonyl, or polymeric or oligomeric oxyethylene segments. Precursor polyesters used to form the wrinkled polyester particles useful in this invention will additionally contain one or more polyacid or polyol monomers, which contain ethylenic unsaturation as detailed above. The water-soluble, surfactant-like, and self-emulsifying precursor polyesters used to form the wrinkled polyester particles of this invention may contain one or more diacid or diol components, which can induce hydrophilic character or water-solubility. The most common hydrophilic diol used for this purpose is polyethylene glycol. Additionally, tertiary amine units substituted with two or three hydroxyalkyl groups can be incorporated within a precursor polyester and rendered ionic either by quaternization with an alkylating agent or by neutralization with an acid. A commonly used class of diacid components used to impart hydrophilicity to polyesters includes compounds containing sulfonate or sulfonimide salts. Some suitable sulfonated diacids are described in U.S. Pat. Nos. 4,973,656 and 5,218,042 and are incorporated herein by reference. Examples of such diacids are 5-sodiosulfoisophthalic acid, 2-sodiosulfobutanoic acid, and di-Me sodioiminobis (sulfonyl-m-benzoate). Another common strategy for the hydrophilization of polyesters involves the neutralization of the acid end groups of polyester with a relatively high acid number. Preferably, the acid number is at least 10 mg KOH/g polymer. Most preferably the acid number is greater than 25 mg KOH/g polymer. The neutralization agent is usually an alkali metal hydroxide or an amine. Polyesters containing ethylenic unsaturation and neutralized acid end groups can also be used in this invention. Preferably, the unsaturated precursor polyester will contain an ionic group equivalent molecular weight of between 200 and 20,000 grams of polymer per mole of ionic unit. Most preferably, the unsaturated precursor polyester will contain an ionic group equivalent molecular weight of between 600 and 6000 grams of polymer per mole of ionic unit.

The ethylenically unsaturated monomers useful for crosslinking the precursor polyesters in this invention are monomers commonly used in the art of addition polymerization. Although wrinkled particles can often be comprised of a polyester in combination with one monomer, either unifunctional or polyfunctional, a preferred embodiment will comprise a combination of at least one unifunctional monomer and at least one polyfunctional monomer in which the unifunctional monomers comprises 50–99% of the combination. Preferably, the unifunctional monomers will comprise 60–90% of the combination. Most preferably, the unifunctional monomers will comprise 75–90% of the combination. In a preferred embodiment, at least one of the monomers is unifunctional and at least one is polyfunctional, and the monomer may even more preferably comprise an organically soluble monomer.

The precursor polyester will be present in the particles in a weight percent of 0.5–75%. For the purposes of the present invention, the polyester content of the particle may vary from as much as 100 percent polyester to as little as some measurable amount of polyester, for example 0.5 to 100 weight percent. In one embodiment, the weight percent of polyester in the particles will be 1–50%. In another preferred embodiment, the weight percent will be 1–33%.

Unifunctional monomers useful in this invention include, but are not necessarily limited to styrenics, acrylates, and methacrylates, such as methacrylic acid esters, such as methyl methacrylate, ethyl methacrylate, isobutyl methacrylate, 2-ethylhexyl methacrylate, benzyl methacrylate, phenoxyethyl methacrylate, cyclohexyl methacrylate and glycidyl methacrylate, acrylate esters such as methyl acrylate, ethyl acrylate, isobutyl acrylate, 2-ethylhexyl acrylate, benzyl methacrylate, phenoxyethyl acrylate, cyclohexyl acrylate, and glycidyl acrylate, styrenics such as styrene, α-methylstyrene, 3- and 4-chloromethylstyrene, halogen-substituted styrenes, and alkyl-substituted styrenes, vinyl halides and vinylidene halides, N-alkylated acrylamides and methacrylamides, vinyl esters such as vinyl acetate and vinyl benzoate, vinyl ethers, such as butyl vinyl ether, allyl alcohol and its ethers and esters, and unsaturated ketones and aldehydes such as acrolein and methyl vinyl ketone and acrylonitrile.

Polyfunctional monomers which are useful in this invention include, but are not necessarily limited to divinylbenzene and related isomers, diol dimethacrylates, such as ethylene glycol dimethyacrylate, divinyl ethers such as cyclohexanedimethanol divinyl ether and ethylene glycol divinyl ether, divinyl esters such as divinyl adipate, and multifunctional acrylates and methacrylates such as trimethylolpropane tri(meth)acrylate.

In addition, small amounts (typically less than 10% of the total weight of the polymerizable solids) of one or more water-soluble ethylenically unsaturated monomer can be used. Such monomers include but are not necessarily limited to styrenics, acrylates, and methacrylates substituted with highly polar groups, unsaturated carbon and heteroatom acids such as acrylic acid, methacrylic acid, fumaric acid, maleic acid, itaconic acid, vinylsulfonic acid, vinylphosphonic acid, and their salts, vinylcarbazole, vinylimidazole, vinylpyrrolidone, divinyl adipate, cyclohexanedimethanol divinyl ether, and vinylpyridines. Monomers (unifunctional and polyfunctional) which are preferred for this invention are styrenics, vinyl ethers, and vinyl esters. Especially preferred monomers are styrenics such as styrene and divinylbenzene.

The method for preparing wrinkled polyester particles comprises crosslinking at least one unsaturated polyester with at least one ethylenically unsaturated monomer within an oil-in-water emulsion in the presence of a water-immiscible organic solvent. The crosslinking reaction is a radical-initiated polymerization of an ethylenically unsaturated monomer, which readily copolymerizes with the unsaturated units in the polyester. The polyester can be organic-soluble, in which case an added emulsifying agent is necessary. In another embodiment of this method, the polyester can be water-soluble, water-dispersible, or amphiphilic in character, in which case the polyester acts as the emulsifying species and an added emulsifying agent is merely optional. The water-immiscible organic solvent is removed by any means, including boiling, evaporation, solvent extraction, vacuum drying, or dialysis to yield a dispersion of porous, crosslinked, polyester-containing particles. In yet another method, bowl-shaped wrinkled polyester-containing particles may be formed by preparing a mixture of an organic phase and an aqueous phase, said mixture comprising an unsaturated precursor polyester, at least one organic-soluble ethylenically unsaturated monomer, and initiator, subjecting said mixture to high energy emulsification, initiating crosslinking of said polyester after emulsification, and removing said water immiscible organic solvent to recover wrinkled polyester-containing particles.

These methods can be easily scaled up and can be applied to a very wide variety of unsaturated polyesters, which can be water-soluble, water-dispersible, or oil-soluble. The polyesters which can be used are not restricted by their glass transition temperature and a diversity of wrinkled particle morphologies can be afforded by this technique. This method comprises preparing a mixture of an organic phase and an aqueous phase comprising an unsaturated polyester, a water immiscible organic solvent, at least one organic-soluble monomer, an initiator, and optionally an added surfactant, emulsifier, cosurfactant, or stabilizer compound. The polyester and initiator may be present in the mixture in either the aqueous or organic phase. The mixture is subjected to high energy emulsification by any of a variety of methods including, but not limited to high shear mixing, sonication, homogenization and microfluidization and crosslinking is initiated by either heating or addition of one component of a multiple component redox initiation system. In the preferred embodiment, heating should be in the temperature range of between 30 and 100° C. and for a period of between 0.5 and 16 hours. The water immiscible organic solvent is then removed to afford an aqueous dispersion of the porous polyester particles, which can then be isolated as a solid if desired.

The precursor polyesters and monomers, which are useful in the preparation of the wrinkled polyester-containing particles, are described in preceding sections of this document. In the preferred embodiment, the precursor polyester will comprise at least 20 mole percent unsaturated diacid units based on total diacid units and will be amphiphilic, self-emulsifying, or surfactant-like. Also in the preferred embodiment, the polyester will contain ionic groups which will be present in amounts sufficient to afford an ionic group equivalent molecular weight of between 600 and 6000 grams of polymer per mole of ionic unit. Preferably the precursor polyester will comprise sulfonated repeating units.

Also in the preferred embodiment of this invention the monomers used will include a combination of al least one unifunctional monomer and at least one polyfunctional monomer in which the unifunctional monomers comprises 50–99% by weight of the combination. Preferably, the unifunctional monomers will comprise 60–90% of the combination. Most preferably, the unifunctional monomers will comprise 75–90% of the combination. The precursor polyesters and the combined monomers will be present in the initial reaction mixture in a weight ratio (precursor polyesters:monomers) which will may vary from 1:99 to 10:1. Preferably, the ratio will vary from 1:19 to 1:1. Most preferably, the ratio will vary from 1:10 to 1:2. If a water-soluble, water-dispersible, or amphiphilic polyester is used with relatively high ratios (>1:2) of polyester-monomers, particles with very highly irregular surfaces may be obtained, but large amounts of polyester will often remain unincorporated in the aqueous phase.

Any of the common water-soluble or organic-soluble free radical polymerization initiators known in the art of addition polymerization can be used in the preparation of the wrinkled polyester-containing particles of this invention. These include, but are not restricted to azo compounds, such as 2,2'-azobis(4-methoxy-2,4-dimethylvaleronitrile), (1-phenylethyl)azodiphenylmethane, 2-2'-azoisobutyronitrile (AIBN), 1,1'-azobis(1-cyclohexanedicarbonitrile), 4,4'-azobis(4-cyanopentanoic acid), and 2,2'-azobis(2-amidinopropane)dihydrochloride, organic peroxides, organic hydroperoxides, peresters, and peracids such as benzoyl peroxide, lauryl peroxide, capryl peroxide, acetyl peroxide, t-butyl hydroperoxide, t-butyl perbenzoate, cumyl hydroperoxide, peracetic acid, 2,5-dimethyl-2,5-di(peroxybenzoate), and p-chlorobenzoyl peroxide, persulfate salts such as potassium, sodium and ammonium persulfate, disulfides, tetrazenes, and redox initiator systems such as $H_2O_2Fe^{2+}$, persulfatelbisulfite, oxalic acid/$Mn^{3+}$, thiourea/$Fe^{3+}$, and benzoyl perozideldimethylaniline.

The organic solvents useful in the preparation of the wrinkled polyester-containing particles of this invention include or are defined as water immiscible, carbon containing compounds, which are liquids at or below room temperature. A water-immiscible organic solvent is included in the organic phase of this invention. The sole criteria for the selection of this solvent is that it is water-immiscible, and does not quench the crosslinking reaction or undergo any other side reactions to an appreciable extent that it would interfere with the process or introduce any unintended byproducts or contaminants. It is desirable that the organic-soluble monomers and the organic soluble polyester are soluble in this solvent. It is not necessarily required, however that the product polyester particles have a high compatibility with the solvent or can be readily swelled by the solvent. It is furthermore desirable, but not required, that the solvent have a boiling point sufficiently low as to be easily removed by evaporation under atmospheric or reduced pressure. Useful water-immiscible organic solvents of this invention include, but are not necessarily limited to toluene, benzene, acetate esters, such as ethyl acetate, propyl acetate, butyl acetate, carbon tetrachloride, chloroform, isopropyl ether, butyl ether, xylene and related isomers, hexane, heptane, octane, petroleum ethers, cyclohexanol, butanol, 1-dodecanol, cyclohexanone, chloroform, methylene chloride, 1-octanol, cyclohexanol, and 1,2-dichloroethane. Toluene, ethyl acetate, and propyl acetate are preferred. In certain variations of this method wherein the polyester has very limited solution compatibility with the monomer mixture, omission of the water-immiscible organic solvent may yield bowl-shaped particles.

Optionally, a small amount of a cosurfactant stabilizer, typically comprising 1–10% by weight of the organic phase, may be added to the organic phase in the preparation of the wrinkled polyester-containing particles of this invention. These hydrophobic compounds are known to prevent Ostwald ripening in certain types of emulsion and suspension polymerization. Excellent discussions of cosurfactants are given in *Emulsion Polymerization and Emulsion Polymers* by Peter A Lovell and Mohammed S. El-Aaser, (John Wiley and Sons: Chichester, 1997, pp. 700–721) and U.S. Pat. No.

5,858,634. The most common cosurfactants are hexadecane and hexadecanol. Other useful cosurfactants may also serve other roles, such as acting as monomers or initiators. An example of the former is lauryl methacrylate. An example of the latter is lauroyl peroxide.

If a polymer, preferably polyester, is used in this invention which is not soluble or dispersible in water, then an emulsifier must additionally be used, although an emulsifier can be used in tandem with a water-soluble or water-dispersible polyester. It is preferable that the emulsifier be present in the aqueous phase. Though a very large variety of emulsifiers are known in the art, most of these fit into the three basic categories of surfactants, colloidal inorganics, and protective colloids. There exist a tremendous number of known surfactants. Good reference sources for surfactants are the Surfactant Handbook (GPO: Washington, D. C., 1971) and *McCutcheon 's Emulsiflers and Detergents* (Manufacturing Confectioner Publishing Company: Glen Rock, 1992). There are no general restrictions for the surfactants, which are useful in this invention. Useful surfactants can be anionic, cationic, zwitterionic, neutral, low molecular weight, macromolecular, synthetic, or extracted or derived form natural sources. Some examples include, but are not necessarily limited to: sodium dodecylsulfate, sodium dodecylbenzenesulfonate, sulfosuccinate esters, such as those sold under the AEROSOL® trade name, flourosurfactants, such as those sold under the ZONYL® and FLUORAD® trade names, ethoxylated alkylphenols, such as TRITON® X-100 and TRITON® X-705, ethoxylated alkylphenol sulfates, such as RHODAPEX® CO-436, phosphate ester surfactants such as GAFAC® RE-90, hexadecyltrimethylammonium bromide, polyoxyethylenated long-chain amines and their quaternized derivatives, ethoxylated silicones, alkanolamine condensates, polyethylene oxide-co-polypropylene oxide block copolymers, such as those sold under the PLURONIC® and TECTRONIC® trade names, hydrophobe-end capped oligoacrylamides, such as those described in U.S. Pat. Nos. 6,127,453; 6,391,537; and U.S. Ser. No. 10/118,725 filed Apr. 9, 2002 "Polymer Particle Stabilized By Dispersant/Surfactant and Method of Preparation" by Erdtmann et al, N-alkylbetaines, N-alkyl amine oxides, and fluorocarbon-poly(ethylene oxide) block surfactants, such as FLUORAD® FC430.

Protective colloids useful in the preparation of the wrinkled particles of this invention include, but are not necessarily limited to: poly (ethylene oxide), hydroxyethyl cellulose, poly (vinyl alcohol), poly (vinyl pyrrolidone), polyacrylamides, polymethacrylamides, sulfonated polystyrenes, alginates, carboxy methyl cellulose, polymers and copolymers of dimethylaminoethylmethacrylate, water soluble complex resinous amine condensation products of ethylene oxide, urea and formaldehyde, polyethyleneimine, casein, gelatin, albumin, gluten and xanthan gum. Protective colloids are a class of emulsifiers, which are used in lieu of or in addition to a surfactant. They are typically dissolved or dispersed in the aqueous phase prior to the emulsification step.

Similarly, colloidal inorganic particles can be employed as emulsifiers as part of a limited coalescence process. Colloidal inorganic particles can be employed in lieu of or in addition to any other type of emulsifier listed, such as a surfactant or protective colloid. They are also dispersed in the aqueous phase. Limited coalescence techniques have been describe in numerous patents such as U.S. Pat. Nos. 4,833,060 and 4,965,131. A colloidal inorganic which is particularly useful in this invention is LUDOX® TM sold by Du Pont.

Preferably, the emulsifier is selected from the group consisting of hydrophobe end-capped oligoacrylamides, sulfosuccinate esters and their salts, tetraalkylammonium salts, alkylphenol ethoxylates, PEO-PPO block copolymers, poly (vinyl alcohol), poly(vinyl pyrrolidone), salts of long chain alkylsulfonates, sulfonated alkylated diphenyl ethers, naphthalenesulfonate salts, alkylbenzenesulfonate salts, and colloidal silica.

Additional additives which can be incorporated into the wrinkled particles useful in this invention include pigments, dyes, biocides, fungicides, electrolytes, buffers, UV-absorbers, antioxidants and chain transfer agents.

The wrinkled, preferably polyester-containing, particles of this invention comprise wrinkled polyester particles having a mean diameter of between 0.05 and 20 micrometers. A mean diameter less than 10 micrometers is preferred. More preferably, the wrinkled particles have a mean diameter range between 0.1 and 5.0 micrometers, and most preferably, that the wrinkled particles have a mean diameter range between 0.1 and 2.0 micrometers. A mean diameter less than 0.5 micrometers is also more preferred. The diameter of the particles can be measured by any method known in the art. One such method is laser light scattering of dilute dispersions of the particles, using a commercially available instrument such as the Horiba LA-920, manufactured by Horiba LTD.

The ink receiving element utilized in the invention may include multiple individual ink receiving layers. The wrinkled particles of the present invention may be present in one or more than one of any ink receiving layer. Each layer may be comprised of a different composition, combination of particles with differing chemical nature and different mean diameters, and layer thickness. For these multilayer structures, the terms as used herein, "lop", "upper", and "above" mean the layer that is farther from the support in relation to the relative positioning with respect to the other layers. The terms "bottom", "lower", and "below" mean the layer that is closer to the support in relation to the relative positioning with respect to the other layers. The term "topmost" means the layer that is the farthest from the support relative to all other layers.

When the ink recording element comprises more than one ink receiving layer capable of accepting an image, the wrinkled particles may be present in any receiving layer. When the wrinkled particles are in the topmost layer, it is preferable that the wrinkled particles have a mean diameter range between 0.1 and less than 0.5 micrometers, and more preferably, that the wrinkled particles have a mean diameter range between, 0.2 and 0.3 micrometers. In one embodiment, the topmost layer may comprise an ink receiving layer. The topmost layer may also comprise particles, including organic or inorganic particles having a mean diameter of less than 0.5 micrometers. In one embodiment, these particles may comprise polyester-containing particles, latex particles, including polymers derived from styrenic, acrylic, or methacrylic monomers, and inorganic particles, such as silicon dioxide, alumina, calcium carbonate, and barium sulfate particles. In a preferred embodiment, the topmost layer further comprises a binder polymer, including, but not limited to poly(vinyl alcohol), gelatin, sulfonated polyester, a hydrogel, an organic polymer and water dispersible polyurethane.

The topmost layer may be substantially free of non-wrinkled particles. The topmost layer may also be substantially free of any type of particle. In an additional embodiment, the topmost layer may not be an ink receiving layer For optimal ink absorption properties and coating quality of the lower layer(s) or layers below the topmost layer which may contain the particles of the present invention, it is preferable that the wrinkled particles have a mean diameter greater than 0.5 micrometers, preferably having a mean diameter between 1 and 10 micrometers, and most preferably having a mean diameter between 1 and 3 micrometers. Typically, a sample of wrinkled particles will contain a population of particles having a distribution of sizes. This is the particle size distribution, and is characterized by a mean diameter, a standard deviation, and a coefficient of variation. The mathematical equations defining these terms can be found in any basic text on statistical analysis, such as "Principles of Instrumental Analysis, $4^{th}$ Edition", by D. A. Skoog and J. J. Leary, Harcourt Brace College Publishers, Orlando, Fla., 1971 (Appendix A-6). The mean diameter is the arithmetic mean of the particle size distribution. The coefficient of variation (CV) of a distribution is the ratio of the standard deviation of the distribution to the mean diameter, given as a percent. The wrinkled particles useful for this invention can have a relatively large distribution of particle sizes within one mode. In a system of particles, there can be a single mode or peak to this distribution of sizes, or there can be several modes, each mode being characterized by a mean diameter, a standard deviation, and a coefficient of variation. For example, the wrinkled particles can be a system composed of particles having a mode with a mean diameter of less than 0.5 micrometers and particles having a mode with mean diameter greater than 0.5 micrometers, preferably having a mean diameter between 1 and 10 micrometers, and most preferably having a mean diameter between 1 and 3 micrometers. The relative proportions of these two modes are calculated from the relative areas under the curves representing the modes, and should add up to 100%.

In addition to the ink receiving layer comprising the wrinkled particles, the ink recording element may also contain other layers. Materials useful for these layers, as well as the wrinkled particle containing layer or layers, include organic or inorganic particles and polymeric binder, or, in a layer substantially free of particles, especially a topmost layer, a highly swellable polymer such as gelatin.

The organic particles in the layer(s) useful for this invention may include non-coalescing latex particles and core-shell latex particles, such as acrylics, polyolefins, polyethylene, polypropylene, polystyrene, poly(styrene-co-butadiene), polyurethane, polyester and polyester-containing, poly(acrylate), poly(methacrylate), copolymers of n-butylacrylate and ethylacrylate, copolymers of vinylacetate and n-butylacrylate, copolymers of methyl methacrylate and sodium 2-sulfo-1,1-dimethylethyl acrylamide, and copolymers of ethyl acrylate, vinylidene chloride and sodium 2-sulfo-1,1-dimethylethyl acrylamide or mixtures thereof. These can be internally crosslinked or uncrosslinked. It is preferable that uncrosslinked latex particles have a film formation temperature above 25° C. Organic particles useful for this invention can also be porous acrylic, methacrylic, polyester, or styrenic polymer particles.

The inorganic particles in the layer(s) useful for this invention include any inorganic oxide, including silica, colloidal silica, fumed silica, alumina, colloidal alumina, fumed alumina, calcium carbonate, kaolin, talc, calcium sulfate, natural or synthetic clay, barium sulfate, titanium dioxide, zinc oxide, or mixtures thereof. Mixtures of organic and inorganic particles may also be used. The organic particles and inorganic particles can be of any size, however, it is preferable that their mean particle diameter be of less than 0.5 micrometers if the layer containing these particles is the topmost layer.

The highly swellable polymer layer useful for this invention may include hydrophilic organic polymers and lightly crosslinked hydrogels such as polyvinylpyrrolidone and vinylpyrrolidone-containing copolymers, polyethyloxazoline and oxazoline-containing copolymers, imidazole-containing polymers, polyacrylamides and acrylamide-containing copolymers, poly(vinyl alcohol) and vinyl-alcoholcontaining copolymers, poly(vinyl methyl ether), poly(vinyl ethyl ether), poly(alkylene oxide), gelatin, cellulose ethers, poly(vinylacetamides), partially hydrolyzed poly(vinyl acetate/vinyl alcohol), poly(acrylic acid), sulfonated or phosphated polyesters and polystyrenes, casein, albumin, chitin, chitosan, dextran, pectin, collagen derivatives, collodian, agar-agar, arrowroot, guar, carrageenan, tragacanth, xanthan, rhamsan and the like, hydroxyethyl cellulose, hydroxypropyl cellulose, hydroxypropyl methyl cellulose, methyl cellulose, a poly(alkylene oxide), and water dispersible polyurethane. Mixtures of the above listed hydrophilic polymers can be used.

The ink receiving layers of the ink recording element are formed by coating a mixture comprised of either the wrinkled particles, organic particles, or inorganic particles and a binder in an amount sufficient to impart cohesive strength to the ink recording element but, preferably, in an amount insufficient to alter the interstitial porosity of the porous receiving layers onto a support, and then drying to remove approximately all of the volatile components. In a preferred embodiment, the polymer binder, which may be an organic binder, is a hydrophilic polymer such as polyvinylpyrrolidone and vinylpyrrolidone-containing copolymers, polyethyloxazoline and oxazoline-containing copolymers, imidazole-containing polymers, polyacrylamides and acrylamide-containing copolymers, poly(vinyl alcohol) and vinyl-alcohol-containing copolymers, poly (vinyl methyl ether), poly(vinyl ethyl ether), poly(alkylene oxide), gelatin, cellulose ethers, poly(vinylacetamides), partially hydrolyzed poly(vinyl acetate/vinyl alcohol), poly (acrylic acid), sulfonated or phosphated polyesters and polystyrenes, casein, albumin, chitin, chitosan, dextran, pectin, collagen derivatives, collodian, agar-agar, arrowroot, guar, carrageenan, tragacanth, xanthan, rhamsan and the like. In another preferred embodiment of the invention, the hydrophilic polymer is hydroxyethyl cellulose, hydroxypropyl cellulose, hydroxypropyl methyl cellulose, methyl cellulose, or a poly(alkylene oxide). In still another preferred embodiment, the polymeric binder is a latex such as poly (styrene-co-butadiene), a polyurethane latex, a polyester latex, poly(acrylate), poly(methacrylate), a copolymer of n-butylacrylate and ethylacrylate, and a copolymer of vinylacetate and n-butylacrylate. In still another preferred embodiment, the polymeric binder is a water dispersible condensation polymer such as a polyurethane. In still another preferred embodiment, the binder is a condensate of alkoxysilanes or other metal sols such as alumina sol, titania sol, or zirconia sol. Mixtures of the above listed hydrophilic polymers can be used. The binder should be chosen so that it is compatible with the aforementioned particles.

The amount of polymeric binder used should be sufficient to impart cohesive strength to the ink recording element, but should also be minimized so that the interconnected interstitial pore structure formed by the aggregates is not filled in by the binder. In a preferred embodiment of the invention, the wrinkled particles are present in an amount of between 50 and 95% by weight, and most preferably, in an amount between 75 and 90% by weight of an individual layer. In a preferred embodiment of the invention, the polymer binder is present in an amount of between 5 and 50% by weight, and most preferably, in an amount between 10 and 25% by weight of an individual layer.

The total thickness of the combined ink rcceiving layers may range from about 5 to about 100 μm, preferably from about 10 to about 50 μm. Each layer may have a different thickness relative to the other layers. However, it is typical that the topmost layer be thin relative to the lower layers. A preferred thickness of the topmost layer is from about 1 to about 20 μm, more preferably from about 1 to about 10 μm. The coating thickness required is determined through the need for the coating to act as a sump for absorption of ink solvent and the need to hold the ink near the coating surface.

Since the image recording element may come in contact with other image recording articles or the drive or transport mechanisms of image recording devices, additives such as filler particles, surfactants, lubricants, crosslinking agents, matte particles and the like may be added to the element to the extent that they do not degrade the properties of interest.

Filler particles may be used in the ink receiving layer such as silicon oxide, fumed silica, silicon oxide dispersions such as those available from Nissan Chemical Industries and DuPont Corp., aluminum oxide, fumed alumina, calcium carbonate, barium sulfate, barium sulfate mixtures with zinc sulfide, inorganic powders such as y-aluminum oxide, chromium oxide, iron oxide, tin oxide, doped tin oxide, aluminosilicate, titanium dioxide, silicon carbide, titanium carbide, and diamond in fine powder, as described in U.S. Pat. No. 5,432,050.

A dispersing agent or wetting agent can be present to facilitate the dispersion of the filler particles. This helps to minimize the agglomeration of the particles. Useful dispersing agents include, but are not limited to, fatty acid amines and commercially available wetting agents such as Solsperse® sold by Zeneca, Inc. (ICI). Preferred filler particles are silicon oxide, aluminum oxide, calcium carbonate, and barium sulfate. Preferably, these filler particles have a median diameter less than 1.0 μm. The filler particles can be present in the amount from about 0 to 80 percent of the total solids in the dried ink receiving layer, most preferably in the amount from about 0 to 40 percent.

The ink recording element may include lubricating agents. Lubricants and waxes useful either in the ink receiving layer or on the side of the IS element that is opposite the ink receiving layer include, but are not limited to, polyethylenes, silicone waxes, natural waxes such as carnauba, polytetrafluoroethylene, fluorinated ethylene propylene, silicone oils such as polydimethylsiloxane, fluorinated silicones, functionalized silicones, stearates, polyvinylstearate, fatty acid salts, and perfluoroethers. Aqueous or non-aqueous dispersions of submicron size wax particles such as those offered commercially as dispersions of polyolefins, polypropylene, polyethylene, high density polyethylene, microcrystalline wax, paraffin, natural waxes such as carnauba wax, and synthetic waxes from such companies as, but not limited to, Chemical Corporation of America (Chemcor), Inc., Michelman Inc., Shamrock Technologies Inc., and Daniel Products Company, are useful.

In order to obtain adequate coatability, additives known to those familiar with such art such as surfactants, defoamers, alcohol and the like may be used. Coating aids and surfactants include, but are not limited to, nonionic fluorinated alkyl esters such as FCA430®, FC431®, FC-10®, FC-171® sold by Minnesota Mining and Manufacturing Co., Zonyl® fluorochemicals such as Zonyl-FSN®, Zonyl-FTS®, Zonyl-TBS®, Zonyl-BA® sold by DuPont Corp., other fluorinated polymer or copolymers such as Modiper F600® sold by NOF Corporation, polysiloxanes such as Dow Coming DC 1248®, DC200®, DC510®, DC 190® and BYK 320®, BYK 322®, sold by BYK Chemie and SF 1079®, SF1023®, SF 1054®, and SF 1080® sold by General Electric, and the Silwet® polymers sold by Union Carbide, polyoxyethylene-lauryl ether surfactants, sorbitan laurate, palmitate and stearates such as Span® surfactants sold by Aldrich, poly (oxyethylene-co-oxypropylene) surfactants such as the Pluronic® family sold by BASF, and other polyoxyethylene-containing surfactants such as the Triton X® family sold by Union Carbide, ionic surfactants, such as the Alkanol® series sold by DuPont Corp., and the Dowfax® family sold by Dow Chemical. Specific examples are described in MCCUTCHEON's Volume 1: Emulsifiers and Detergents, 1995, North American Edition.

The ink receiving layer may include crosslinking agents. Any crosslinking agent may be used provided its reactive functionalities have the appropriate reactivity with specific chemical units in the binder. Some common crosslinkers which can crosslink binders rich in lewis basic functionalities include, but are not necessarily limited to: carbodiimides, polyvalent metal cations, organic isocyanates such as tetramethylene diisocyanate, hexamethylene diisocyanate, diisocyanato dimethylcyclohexane, dicyclohexylmethane diisocyanate, isophorone diisocyanate, dimethylbenzene diisocyanate, methylcyclohexylene diisocyanate, lysine diisocyanate, tolylene diisocyanate, diphenylmethane diisocyanate, aziridines such as taught in U.S. Pat. No. 4,225,665, ethyleneimines such as Xama-7® sold by EIT Industries, blocked isocyanates such as CA BI-12 sold by Cytec Industries, melamines such as methoxymethylmelamine as taught in U.S. Pat. No. 5,198,499, alkoxysilane coupling agents including those with epoxy, amine, hydroxyl, isocyanate, or vinyl functionality, Cymel® crosslinking agents such as Cymel 300®, Cymel 303®, Cymel 1170®, Cymel 1171° sold by Cytec Industries, and bis-epoxides such as the Epon® family sold by Shell. Other crosslinking agents include compounds such as aryloylureas, aldehydes, dialdehydes and blocked dialdehydes, chlorotriazines, carbamoyl pyridiniums, pyridinium ethers, formamidinium ethers, vinyl sulfones, boric acid, dihydroxydioxane, and polyfunctional aziridines such as CX-100 (manufactured by Zeneca Resins). Such crosslinking agents can be low molecular weight compounds or polymers, as discussed in U.S. Pat. No. 4,161,407 and references cited.

To improve colorant fade, UV absorbers, radical quenchers or antioxidants may also be added to the ink-receiving layer as is well known in the art. Examples include polyalkylenepolyamine-dicyanodiamide based polycondensafion products, water soluble reducing agents, such as sulfites, nitrites, phosphates, thiosulfates, ascorbic acid or salts thereof, hydroxylarine derivatives, and glucose, sulfur-containing compounds, such as thiocyanates, thiourea, 2-mercaptobenzimidazole, 2-mercaptobenzthiazole, 2-mercaptobenzoxazole, 5-mercapto-1-methyl-tetrazole, 2,5-dimercapto-1,3,4-triazole, 2,4,6-trimercaptocyanuric acid, thiosalicylic acid, thiouracil, 1,2-bis(2-hydroxyethylthio)ethane, or hydrophobic antioxidant emulsified dispersions, such as hindered phenol based antioxidants, piperidine based antioxidants or hindered amines. UV absorbers include those described in Japanese Patent Publication Open to Public Inspection Nos. 57-74193, 57-87988, and 2-261476, antifading agents include those described in Japanese Patent Publication Open to Public Inspection Nos. 57-74192, 57-87989, 60-72785, 61-146591, 1-95091, and 3-13376.

The ink receiving layer may include pH modifiers, adhesion promoters, rheology modifiers, latexes, biocides, dyes, optical brighteners, whitening agents, described in Japanese Patent Publication Open to Public Inspection Nos. 59-42993, 59-52689, 62-280069, 61-242871, and 4-219266, and antistatic agents.

The ink receiving layer of the invention can contain one or more mordanting species or polymers. The mordant polymer can be a soluble polymer, a charged molecule, or a crosslinked dispersed microparticle. The mordant can be non-ionic, cationic or anionic. Examples of a mordant are polymers or copolymers containing a quaternized nitrogen moiety, such as, for example, poly(styrene-co-1-vinylimidazole-co-1-vinyl-3-benzylimidazolium chloride), poly(styrene-co-1-vinylimidazole-co-1-vinyl-3-hydroxyethyl-imidazolium chloride), poly(styrene-co-1-vinylimidazole-co-1-vinyl-3-benzylirnidazolium chloride-co-1-vinyl-3-hydroxyethylimidazolium chloride), poly (vinylbenzyltrimethylammonium chloride-co-divinylbenzene), poly(ethyl acrylatec-co-1-vinylimidazole-co-1-vinyl-3-benzylimidazolium chloride), or poly(styrene-co-4-vinylpyridine-co-4-hydroxyethyl-1-vinylpyridinium chloride). In a preferred embodiment of the invention, the quaternary nitrogen moiety incorporated in the polymer is a salt of trimethylvinylbenzylammonium, benzyldimethylvinylbenzylammonium, dimethyloctadecylvinylbenzylammonium, glycidyltrimethylammonium, 1-vinyl-3-benzylimidazolium, 1-vinyl-3-hydroxyethylimidazolium or 4-hydroxyethyl-1-vinylpyridinium. Preferred counter ions, which can be used, include chlorides or other counter ions as disclosed in U.S. Pat. Nos. 5,223,338, 5,354,813, and 5,403,955, the disclosures of which are hereby incorporated by reference. Other mordants suitable for the invention are cationic modified products of polymers such as poly(vinyl alcohol), gelatin, chitosan, polyvinylamine, polyethylene-imine, polydimethyidiallyl ammonium chloride, polyalkylene-polyamine dicyandiamide ammonium condensate, polyvinylpyridinium halide, polymers of (meth)acryloyl oxyalkyl quaternary ammonium salt, polymers of (meth)acrylamide alkyl quaternary ammonium salt, uchloro-poly(oxyethylene-polymethylene quaternary ammonium alkylate). methyl glycol chitosan, poly(vinylpyridine), propylene oxide based triamines of the Jeffamine T series, made by Texaco, Inc., quaternary acrylic copolymer latexes, phosphonium compounds, sulfonimides, sulfonated polymers and dispersed particles, arid alumina hydrate. Other mordants suitable for the invention are polymers, copolymers, or latexes containing carboxylic acid, sulfonic acid, sulfonamide, sulfonimide, or phosphonic acid, such as carboxylated and sulfonated acrylates or methacrylates, carboxylated styrene butadienes, sulfonated nylons, polyesters and polyurethanes, and their salts. In a preferred embodiment of this invention, the mordanting unit may be chemically incorporated within the chemical structure of the polyester particle. For example, a sulfonated monomer within the wrinkled polyester structure may serve as a mordant for cationic dye species. Similarly, a polyester particle may be prepared using a chloromethylstyrene vinyl monomer and quatemized with a tertiary amine to afford a particle with quaternary ammonium units capable of mordanting anionic dyes.

The support for the ink recording element used in the invention can be any of those usually used for inkjet receivers. The support can be either transparent or opaque. Opaque supports include plain paper, coated paper, resin-coated paper such as polyolefin-coated paper, synthetic paper, photographic paper support, melt-extrusion-coated paper, and polyolefin-laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. The support can also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Transparent supports include glass, cellulose derivatives, such as a cellulose ester, cellulose tri acetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The papers listed above include a broad range of papers, from high end papers, such as photographic paper to low end papers, such as newsprint. In a preferred embodiment, Ektacolor paper made by Eastman Kodak Co. is employed. The term as used herein, "transparent" means the ability to pass radiation without significant deviation or absorption.

The support used in the invention may have a thickness of from about 50 to about 500 $\mu$m, preferably from about 75 to 300 $\mu$m. Antioxidants, brightening agents, antistatic agents, plasticizers and other known additives may be incorporated into the support, if desired.

In order to improve the adhesion of the ink receiving layer to the support, an under-coating or subbing layer may be applied to the surface of the support. This layer may be an adhesive layer such as, for example, halogenated phenols, partially hydrolyzed vinyl chloride-co-vinyl acetate polymer, vinylidene chloride-methyl acrylate-itaconic acid terpolymer, a vinylidene chloride-acrylonitrile-acrylic acid terpolymer, or a glycidyl (meth)acrylate polymer or copolymer. Other chemical adhesives, such as polymers, copolymers, reactive polymers or copolymers, that exhibit good bonding between the ink receiving layer and the support can be used. The polymeric binder in the subbing layer employed in the invention is preferably a water soluble or water dispersible polymer such as poly(vinyl alcohol), poly(vinyl pyrrolidone), gelatin, a cellulose ether, a poly (oxazoline), a poly(vinylacetamide), partially hydrolyzed poly(vinyl acetatelvinyl alcohol), poly(acrylic acid), poly (acrylamide), poly(alkylene oxide), a sulfonated or phosphated polyester or polystyrene, casein, zein, albumin, chitin, chitosan, dextran, pectin, a collagen derivative, collodian, agar-agar, arrowroot, guar, carrageenan, tragacanth, xanthan, rhamsan and the like, a latex such as poly(styrene-co-butadiene), a polyurethane latex, a polyester latex, or a poly(acrylate), poly(methacrylate), poly (acrylamide) or copolymers thereof.

In a preferred embodiment, the subbing layer polymeric binder is a sulfonated polyester dispersion, such as AQ29® (Eastman Chemical Co.), gelatin, a polyurethane or poly (vinyl pyrrolidone). The polymeric binder for the subbing layer is preferably used in an amount of from about 1 to about 50 g/m$^2$, preferably from about 1 to about 20 g/m$^2$.

A borate or borate derivative employed in the subbing layer of the ink jet recording element of the invention may be, for example, borax, sodium tetraborate, boric acid, phenyl boronic acid, or butyl boronic acid. As noted above, the borate or borate derivative is used in an amount of from about 3 to about 50 g/m$^2$, preferably from about 3 to about 10 g/m$^2$. It is believed that upon coating, the borate or borate derivative in the subbing layer diffuses into the image-receiving layer to cross-link the cross-linkable binder in the image-receiving layer.

Other methods to improve the adhesion of the layer to the support include surface treatment of the support by corona-discharge, plasma-treatment in a variety of atmospheres, UV treatment, which is performed prior to applying the layer to the support.

The recording element of the invention can contain one or more conducting layers such as an antistatic layer to prevent undesirable static discharges during manufacture and printing of the image. This may be added to either side of the element. Antistatic layers conventionally used for color films have been found to be satisfactory, such as those in U.S. Pat. No. 5,147,768, the disclosure of which is hereby incorporated by reference. Preferred antistatic agents include metal oxides, e.g., tin oxide, antimony doped tin oxide and vanadium pentoxide. These antistatic agents are preferably dispersed in a film-forming binder.

The layers described above may be coated by conventional coating means onto a support material commonly used in this art. Coating methods may include, but are not limited to, wound wire rod coating, knife coating, slot coating, slide hopper coating, gravure coating, spin coating, dip coating, skim-pan-air-knife coating, multilayer slide bead, doctor blade coating, gravure coating, reverse-roll coating, curtain coating, multilayer curtain coating and the like. Some of these methods allow for simultaneous coatings of more than one layer, which is preferred from a manufacturing economic perspective if more than one layer or type of layer needs to be applied. Known coating and drying methods are described in further detail in Research Disclosure No. 308119, published December 1989, pages 1007–1008. Slide coating is preferled, in which several layers may be simultaneously applied. The support may be stationary, or may be moving so that the coated layer is immediately drawn into drying chambers. After coating, the layers are generally dried by simple evaporation, which may be accelerated by known techniques such as convection heating.

The coating composition may be applied to one or both substrate surfaces through conventional pre-metered or post-metered coating methods listed above. The choice of coating process would be determined from the economics of the operation and, in turn, would determine the formulation specifications such as coating solids, coating viscosity, and coating speed. After coating, the ink recording element may be subject to calendering or supercalendering to enhance surface smoothness. In a preferred embodiment of the invention, the inkjet recording element is subject to hot soft-nip calendering at a temperature of about 65° C. and a pressure of 14000 kg/m at a speed of from about 0.15 m/s to about 0.3 mis.

Inks used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543; and 4,781,758, the disclosures of which are hereby incorporated by reference.

Used herein, the phrase "ink recording element", which may also be referred to as an "imaging element" comprises an imaging support as described above along with an image receiving or recording layer as applicable to multiple techniques governing the transfer of an image onto the imaging element. Such techniques include thermal dye transfer with thermosensitive imaging materials, electrophotographic printing, or inkjet printing, as well as a support for photographic silver halide images. As used herein, the phrase "photographic element" is a material that utilizes photosensitive silver halide in the formation of images. The stabilized particle of the present invention may be used in a single technique or may be used in a hybrid system combining one or more technique. An example of a hybrid system might be an inkjet printing application on a photographic element.

The thermal ink or dye image-receiving or recording layer of the receiving or recording elements of the invention may comprise, for example, a polycarbonate, a polyurethane, a polyester, polyvinyl chloride, poly(styrene-co-acrylonitrile), poly(caprolactone), or mixtures thereof. The ink or dye image-receiving or recording layer may be present in any amount that is effective for the intended purpose. An overcoat layer may be further coated over the ink or dye-receiving or recording layer, such as described in U.S. Pat. No. 4,775,657 of Harrison et al.

Ink or dye-donor elements that are used with the ink or dye-receiving or recording element of the invention conventionally comprise a support having thereon an ink or dye containing layer. Any ink or dye can be used in the ink or dye-donor employed in the invention, provided it is transferable to the ink or dye-receiving or recording layer by the action of,heat. Ink or dye donors applicable for use in the present invention are described, e.g., in U.S. Pat. Nos. 4,916,112; 4,927,803; and 5,023,228. As noted above, ink or dye-donor elements are used to form an ink or dye transfer image. Such a process comprises image-wise-heating an ink or dye-donor element and transferring an ink or dye image to an ink or dye-receiving or recording element as described above to form the ink or dye transfer image. The thermal ink or dye transfer method of printing, an ink or dye donor element may be employed which comprises a poly(ethylene terephthalate) support coated with sequential repeating areas of cyan, magenta, and yellow ink or dye, and the ink or dye transfer steps are sequentially performed for each color to obtain a three-color ink or dye transfer image. When the process is only performed for a single color, then a monochrome ink or dye transfer image is obtained.

Thermal printing heads which can be used to transfer ink or dye from ink or dye-donor elements to receiving or recording elements of the invention are available commercially. There can be employed, for example, a Fujitsu Thermal Head (FrP-040 MCS001), a TDK Thermal Head F415 HH7-1089, or a Rohm Thermal Head KE 2008-F3. Alternatively, other known sources of energy for thermal ink or dye transfer may be used, such as lasers as described in, for example, GB No. 2,083,726A.

A thermal ink or dye transfer assemblage may comprise (a) an ink or dye-donor element, and (b) an ink or dye-receiving or recording element as described above, the ink or dye-receiving or recording element being in a superposed relationship with the ink or dye-donor element so that the ink or dye layer of the donor element is in contact with the ink or dye image-receiving or recording layer of the receiving or recording element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving or recording element and the process repeated. The third color is obtained in the same manner.

The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps, the use of liquid toners in place of dry toners is simply one of those variations.

The first basic step, creation of an electrostatic image, can be accomplished by a variety of methods. In one form, the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In an alternate electrographic process, electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent, these toners form a film bonded to the paper. For heat-fusible toners, thermoplastic polymers are used as part of the particle. Heating both removes residual liquid and fixes the toner to paper.

When used as inkjet imaging media, the recording elements or media typically comprise a substrate or a support material having on at least one surface thereof an ink-receiving or recording/recording or image-forming layer. If desired, in order to improve the adhesion of the inkjet receiving or recording layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer, can be applied to the surface of the support. The inkjet receiving or recording layer is preferably coated onto the support layer from water or water-alcohol solutions at a dry thickness ranging from 3 to 75 micrometers, preferably 8 to 50 micrometers.

Any known inkjet receiver layer can be used in combination with other particulate materials. For example, the ink receiving or recording layer may consist primarily of inorganic oxide particles such as silicas, modified silicas, clays, aluminas, fusible beads such as beads comprised of thermoplastic or thermosetting polymers, non-fusible organic beads, or hydrophilic polymers such as naturally-occurring hydrophilic colloids and gums such as gelatin, albumin, guar, xantham, acacia, chitosan, starches and their derivatives, and the like, derivatives of natural polymers such as functionalized proteins, functionalized gums and starches, and cellulose ethers and their derivatives, and synthetic polymers such as polyvinyloxazoline, polyvinylmethyloxazoline, polyoxides, polyethers, poly (ethylene imine), poly(acrylic acid), poly(methacrylic acid), n-vinyl amides including polyacrylamide and polyvinylpyrrolidone, and poly(vinyl alcohol), its derivatives and copolymers, and combinations of these materials. Hydrophilic polymers, inorganic oxide particles, and organic beads may be present in one or more layers on the substrate and in various combinations within a layer.

A porous structure may be introduced into ink receiving or recording layers comprised of hydrophilic polymers by the addition of ceramic or hard polymeric particulates, by foaming or blowing during coating, or by inducing phase separation in the layer through introduction of non-solvent. In general, it is preferred for the base layer to be hydrophilic, but not porous. This is especially true for photographic quality prints, in which porosity may cause a loss in gloss. In particular, the ink receiving or recording layer may consist of any hydrophilic polymer or combination of polymers with or without additives as is well known in the art.

If desired, the ink receiving or recording layer can be overcoated with an ink-permeable, anti-tack protective layer such as, for example, a layer comprising a cellulose derivative or a cationically-modified cellulose derivative or mixtures thereof. An especially preferred overcoat is poly β-1, 4-anhydro-glucose-g-oxyethylene-g-(2'-hydroxypropyl)-N, N-dimethyl-N-dodecylammonium chloride. The overcoat layer is non porous, but is ink permeable and serves to improve the optical density of the images printed on the element with water-based inks. The overcoat layer can also protect the ink receiving or recording layer from abrasion, smudging, and water damage. In general, this overcoat layer may be present at a dry thickness of about 0.1 to about 5 $\mu$m, preferably about 0.25 to about 3 $\mu$m.

In practice, various additives may be employed in the ink receiving or recording layer and overcoat. These additives include surface active agents such as surfactant(s) to improve coatability and to adjust the surface tension of the dried coating, acid or base to control the pH, antistatic agents, suspending agents, antioxidants, hardening agents to cross-link the coating, antioxidants, UV stabilizers, light stabilizers, and the like. In addition, a mordant may be added in small quantities (2%–10% by weight of the base layer) to improve waterfastness. Useful mordants are disclosed in U.S. Pat. No. 5,474,843.

The layers described above, including the ink receiving or recording layer and the overcoat layer, may be coated by conventional coating means onto a transparent or opaque support material commonly used in this art. Coating methods may include, but are not limited to, blade coating, wound wire rod coating, slot coating, slide hopper coating, gravure, curtain coating, and the like. Some of these methods allow for simultaneous coatings of both layers, which is preferred from a manufacturing economic perspective.

The IRL (ink or dye receiving layer) may be coated over a tie layer (TL). There are many known formulations, which may be useful as ink or dye receiving or recording layers. The primary requirement is that the IRL is compatible with the inks which it will be imaged so as to yield the desirable color gamut and density. As the ink drops pass through the IRL, the ink or dyes are retained or mordanted in the IRL, while the ink solvents pass freely through the IRL and are rapidly absorbed by the TL. Additionally, the IRL formulation is preferably coated from water, exhibits adequate adhesion to the TL, and allows for easy control of the surface gloss.

For example, Misuda et al in U.S. Pat. Nos. 4,879,166; 5,264,275; 5,104,730; 4,879,166; and Japanese Patents 1,095,091; 2,276,671; 2,276,670; 4,267,180; 5,024,335; and 5,016,517 disclose aqueous based IRL formulations comprising mixtures of psuedo-bohemite and certain water soluble resins. Light in U.S. Pat. Nos. 4,903,040; 4,930,041; 5,084,338; 5,126,194; 5,126,195; and 5,147,717 discloses aqueous-based IRL formulations comprising mixtures of vinyl pyrrolidone polymers and certain water-dispersible andlor water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous-coatable IRL formulations based on poly(vinyl alcohol). Iqbal in U.S. Pat. No. 5,208,092 discloses water-based IRL formulations comprising vinyl copolymers, which are subsequently cross-linked. In addition to these examples, there may be other known or contemplated IRL formulations, which are consistent with the aforementioned primary and secondary requirements of the IRL, all of which fall under the spirit and scope of the current invention.

The IRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers, and the like.

It may also be desirable to overcoat the IRL for the purpose of enhancing the durability of the imaged element. Such overcoats may be applied to the IRL either before or after the element is imaged. For example, the IRL can be overcoated with an ink-permeable layer through which inks freely pass. Layers of this type are described in U.S. Pat. Nos. 4,686,118; 5,027,131; and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based. However, it is intended that alternative embodiments of the image-recording elements as described above, which may be formulated for use with inks which are specific to a given ink-recording process or to a given commercial vendor, fall within the scope of the present invention.

In another embodiment, in order to produce photographic elements, the composite support sheet is coated with a photographic element or elements. The photographic elements can be single color elements or multicolor elements. Multicolor elements contain image ink or dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea, reducing agents, e.g., polyamines and stannous salts, noble metal compounds, e.g., gold, platinum, and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. By predominantly silver chloride, it is meant that the grains of the emulsion are greater than about 50 mole percent silver chloride. Preferably, they are greater than about 90 mole percent silver chloride, and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular or core/shell grains. Grains having a tabular or cubic morphology are preferred.

The photographic elements of the invention may utilize emulsions as described in The Theory of the Photographic Process, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals that reduce silver ions to forn metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectralchemical sensitization to reduction sensitize an emulsion include ascorbic acid derivatives, tin compounds, polyamine compounds, and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VII metals such as iridium, rhodium, osmium, and iron as described in Research Disclosure, September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan ink or dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. The invention may be utilized with the materials disclosed in Research Disclosure, September 1997, Item 40145. The invention is particularly suitable for use with the material color paper examples of sections XVI and XVII. The couplers of section II are also particularly suitable. The Magenta I couplers of section II, particularly M-7, M-10, M-18, and M-18, set forth below are particularly desirable. In the following Table, reference will be made to (1) Research Disclosure, December 1978, Item 17643, (2) Research Disclosure, December 1989, Item 308119, and (3) Research Disclosure, September 1994, Item 36544, all published by Kenneth Mason Publications, Ltd., Dudley Annex, 12a North Street, Emsworth, Hampshire PO10 7DQ, ENGLAND. Table 1 and the references cited in Table 1 are to be read as describing particular components suitable for use in the elements of the invention. The Table and its cited references also describe suitable ways of preparing, exposing, processing and manipulating the elements and the images contained therein.

TABLE 1

| Reference Section | Subject Matter |
|---|---|
| 1 I, II | Grain composition, |
| 2 I, II, IX, X, XI | morphology and preparation. |
| XII, XIV, XV | Emulsion preparation including |
| I, II, III, IX | hardeners, coating aids, |
| 3 A & B | addenda, etc. |
| 1 III, IV | Chemical sensitization and |
| 2 III, IV | spectral sensitization |
| 3 IV, V | Desensitization. |
| 1 V | UV dyes, optical brighteners, |
| 2 V | luminescent dyes |
| 3 VI | |
| 1 VI | Antifoggants and stabilizers |
| 2 VI | |
| 3 VII | |
| 1 VIII | Absorbing and scattering |
| 2 VIII, XIII, XVI | materials; Antistatic layers; |
| 3 VIII, IX | C & D matting agents |
| 1 VII | Image-couplers and image- |
| 2 VII | modifying couplers; Dye |
| 3 X | stabilizers and hue modifiers |
| 1 XVII | Supports |
| 2 XVII | |
| 3 XV | |
| 3 XI | Specific layer arrangements |
| 3 XII, XIII | Negative working emulsions; Direct positive emulsions |
| 2 XVIII | Exposure |
| 3 XVI | |
| 1 XIX, XX | Chemical processing; |
| 2 XIX, XX, XXII | Developing agents |
| 3 XVIII, XIX, XX | |
| 3 XIV | Scanning and digital processing procedures |

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4.TM. (Eastman Kodak Company) Process or other processing systems suitable for developing high chloride emulsions. This invention is also directed towards a photographic recording element comprising a support and at least one light sensitive silver halide emulsion layer comprising silver halide grains as described above.

Although the recording elements disclosed herein have been referred to primarily as being useful for ink printers, preferably inkjet printers, they also can be used as recording media for pen plotter assemblies. Pen plotters operate by writing directly on the surface of a recording medium using a pen consisting of a bundle of capillary tubes in contact with an ink reservoir.

The following examples are intended to further illustrate, but not to limit, the invention.

EXAMPLES

Preparation of Polyester Particles PE-1 Through PE-6

Synthesis of Precursor Polyester PP-1

TABLE 2

| Reagent # | Reagent | Amount (g) | mole | Mole % in polymer |
|---|---|---|---|---|
| 1 | 5-sulfoisophthalic acid, dimethyl ester, sodium salt. | 64.21 | 0.22 | 18.0 |
| 2 | Dimethyl isophthalate | 74.82 | 0.39 | 32.0 |
| 3 | Diethyl fumarate | 103.65 | 0.60 | 50.0 |
| 4 | Diethylene glycol | 72.84 | 0.69 | 28.5 |
| 5 | 1,4-cyclohexanedimethanol | 74.67 | 0.52 | 21.5 |
| 6 | Sodium acetate | 1.62 | $1.97 \times 10^{-2}$ | — |
| 7 | Dibutyltin oxide | 0.19 | $7.63 \times 10^{-4}$ | — |

Reagents 1 and 4, 6, and 7 were combined in a 500 ml 3-neck flask equipped with a stainless steel stirring rod, nitrogen inlet, and an arm leading to a dry ice/acetone condenser connected to a controlled vacuum system with a graduated cylinder with a ground glass joint attached below the condenser to measure the collected condensate. The reaction was heated in a bath containing a metal heating alloy. A steady stream of nitrogen was passed over the reaction mixture for 10 minutes, and then reduced to a slightly positive flow. The reaction mixture was heated at 200° C. for 120 minutes, at which point a clear prepolymer had formed and the expected amount of methanol condensate had been collected. The remaining reagents were added and stirring was resumed. The reaction was ramped to 220° C. over 50 minutes, held at 220° C. for 120 minutes then ramped to 250° C. over 30 minutes. A vacuum was initiated at 200 torr and ramped to 0.5 torr over 20 minutes. After 10 minutes at 0.5 torr, the viscosity had increased to the point where the polyester could no longer be effectively stirred and the reaction was terminated. The molecular weight of the polymer was determined by size exclusion chromatography (SEC) (dimethylformamide, PEO equivalent) to have Mn=4200 and Mw=15,100.

Synthesis of Precursor Polyester PP-2

TABLE 3

| Reagent # | Reagent | Amount (g) | mole | Mole % in polymer |
|---|---|---|---|---|
| 1 | 5-sulfoisophthalic acid, dimethyl ester, sodium salt. | 47.61 | 0.16 | 12.0 |
| 2 | Neopentyl glycol | 139.47 | 1.34 | 100.0 |
| 3 | Zinc acetate dihydrate | 0.055 | $3.00 \times 10^{-4}$ | — |
| 4 | Fascat 4100 | 0.018 | — | — |
| 5 | Maleic anhydride | 115.57 | 1.18 | 88.0 |

This polyester was prepared in a two stage polycondensation reaction similar to that of PP-1 using the same apparatus except performed entirely at ambient pressure. Reagents 1–4 were heated at 220–230° C. for 100 minutes at which point a clear prepolymer had resulted and the expected amount of methanol had been collected. The reaction was removed from the heating bath and Reagent 5 was added. The reaction was then continued at 220° C. and within 10–15 minutes water condensate began to collect in the trap. The reaction was continued at 220° C. for 690 additional minutes and then terminated. The polyester was found to have Mn=4040 and Mw=37,700 by size exclusion chromatography in dimethylformamide eluent.

Synthesis of Precursor Polyester PP-3

TABLE 4

| Reagent # | Reagent | Amount (g) | mole | Mole % in polymer |
|---|---|---|---|---|
| 1 | 5-sulfoisophthalic acid, dimethyl ester, sodium salt. | 47.96 | 0.41 | 50 |
| 2 | 1,4-Cyclohexane-dimethanol, mixture of cis/trans. | 119.17 | 0.83 | 100 |
| 3 | Sodium acetate | 1.70 | $2.12 \times 10^{-2}$ | — |
| 4 | Zinc acetate dihydrate | 0.022 | $1.20 \times 10^{-4}$ | — |
| 5 | Fascat 4100 | 0.018 | — | — |
| 6 | Fumaric acid | 47.96 | 0.41 | 50 |

This polyester was prepared in a two stage polycondensation reaction similar to that of PP-1 using the same apparatus except performed entirely at ambient pressure. Reagents 1–5 were heated at 220° C. and slowly ramped to 250° C. over 460 minutes at which point a clear prepolymer had resulted and the expected amount of methanol had been collected. The reaction was removed from the heating bath and Reagent 6 was added. The reaction was then continued at 220° C. and within 10–15 minutes water condensate began to collect in the trap. the reaction was continued at 220° C. for 400 additional minutes until the polyseter became too viscous to stir. The polyester was found to have Mn=2720 and Mw=6400 by size exclusion chromatography in dimethylformamide eluent.

Synthesis of Precursor Polyester PP-4

Precursor Polyester PP-4 is a duplicate run Precursor Polyester PP-1 and was prepared by an analogous procedure at 1/3 scale. The molecular weight was found to be slightly lower (Mn=2520, Mw=8040).

In the following synthetic preparations, AIBN (2,2'-azobisisobutyronbitrile) was recrystallized once from ether. Styrene and divinylbenzene were passed through a short column of basic alumina to remove inhibitors. Divinylbenzene consists of 80% m, and p divinylbenzene isomers with the remainder being ethylstyrene isomers.

Preparation of Polyester Dispersion PE-1

TABLE 5

| Component | Reagent | Amount (g) |
|---|---|---|
| 1 | Precursor Polyester PP-1 | 75.0 |
| 2 | Water | 750.0 |
| 3 | Styrene | 40.0 |
| 4 | divinylbenzene | 10.0 |
| 5 | n-hexadecane | 5.0 |
| 6 | Toluene | 125.0 |
| 7 | AIBN | 1.25 |

Precursor Polyester PP-1 was heated in 750.0 ml water at ~60° C. for 1 hour to afford a clear, slightly yellow solution, which was cooled to room temperature. An organic phase was prepared by combining Reagents 3–7. The polyester solution and the organic phase were combined in a 2 L beaker and mixed using a Silverson L4R mixer at the highest speed setting for 10 minutes. The resultant dispersion was poured into a 2 L, 3-neck round bottom flask fitted with a mechanical stirrer, reflux condenser, and nitrogen inlet and bubble degassed with nitrogen for 10 minutes. The reaction was then heated for 16 hours in a thermostatted water bath at 70° C. and the toluene was stripped as a water azeotrope using a rotary evaporator. The particle dispersion was purified by diafiltration with 4 volumes of water using a Millipore Amicon® ultrafiltration system with a 100K cutoff cartridge. The product dispersion was found to have 14.8 wt % solids. The mean particle size was determined to be 1.35 micrometers using a Horiba LA-90 particle size analyzer. Analysis of the particles by electron microscopy showed heavily wrinkled, spherical shapes.

The polyester content of the particles was determined by the following method. 20 ml of methanol was added to 10 mnl of the sample and the dispersion was centrifuged at 9000 RPM for 3 hours. The clear supernatant was decanted, the white solids were redispersed in 25 ml methanol, and the procedure was repeated. The resulting solids were dried in a vacuum oven at 80° C. for 16 hours. Combustion analysis of the purified sample gave 0.15% sulfur. This result shows that the particles consist of 6.38% of polyester. The final concentration of the dispersion was 14.8 wt % solids in water.

Preparation of Polyester PE-2

TABLE 6

| Component | Reagent | Amount (g) |
|---|---|---|
| 1 | Precursor Polyester PP-2 | 10.0 |
| 2 | Water | 428.6 |
| 3 | Styrene | 32.0 |
| 4 | divinylbenzene | 8.0 |
| 5 | n-hexadecane | 2.9 |
| 6 | Toluene | 92.9 |
| 7 | AIBN | 0.25 |

This preparation and analysis of the particles was carried out in a manner analogous to that of PE-1, except that a different purification procedure was used. The particle dispersion was centrifuged for 1 hour and the clear supernatant was discarded. The particles were redispersed in methanol and centrifuged down again. This process was repeated a total of three times and the purified particles were dried in a vacuum oven at 60° C. for 16 hours. 31.45 g was recovered. The mean particle size was determined to be 1.845 micrometers. Analysis of the particles by electron microscopy showed heavily wrinkled particles. The particles were found to contain 0.05% sulfur, which corresponds to 3.82% polyester content.

Preparation of Polyester Dispersion PE-3

TABLE 7

| Component | Reagent | Amount (g) |
|---|---|---|
| 1 | Precursor Polyester PP-3 | 20.0 |
| 2 | Water | 200.0 |
| 3 | Styrene | 10.7 |
| 4 | Divinylbenzene | 2.7 |
| 5 | n-hexadecane | 1.3 |
| 6 | Toluene | 33.3 |
| 7 | AIBN | 0.7 |

This preparation and analysis of the particles was carried out in a manner analogous to that of PE-1. The product dispersion was found to have 12.9 wt % solids. The mean particle size was determined to be 1.408 micrometers. Analysis of the particles by electron microscopy showed heavily wrinkled particles. The particles were found to contain 0.33% sulfur, which corresponds to 6.18% polyester content.

Preparation of Polyester Dispersion PE-4

TABLE 8

| Component | Reagent | Amount (g) |
|---|---|---|
| 1 | Precursor Polyester PP-3 | 30.0 |
| 2 | Water | 300.0 |
| 3 | Styrene | 16.0 |
| 4 | Divinylbenzene | 4.0 |
| 5 | n-hexadecane | 2.0 |
| 6 | Toluene | 50.0 |
| 7 | AIBN | 1.0 |

This preparation and analysis of the particles was carried out in a manner analogous that of PE-3 except that a different emulsification procedure was employed. The combined phases were mixed using a Silverson L4R mixer at the highest speed setting for -3 minutes, then microfluidized by passage twice through a M-110T Microfluidizer (sold by Microfluidics). The product dispersion was found to have 19.3 wt % solids. The mean particle size was determined to be 0.378 micrometers. The distribution, however, had a secondary mode extending 1 to 10 micrometers which is most likely due to agglomerates, so the actual mean diameter is most likely closer to the value of the statistical mode (0.139 micrometers). Analysis of the particles by electron microscopy showed wrinkled and bowl-shaped articles with diameters of 0.050–0.250 micrometers. The particles were found to contain 1.29% sulfur, which corresponds to 24.16% polyester content.

Molvester Disprsion PE-5

TABLE 9

| Component | Reagent | Amount (g) |
|---|---|---|
| 1 | Precursor Polyester PP-4 | 10.0 |
| 2 | Water | 205.0 |
| 3 | Styrene | 5.3 |
| 4 | Divinylbenzene | 1.3 |
| 5 | n-hexadecane | 0.17 |
| 6 | Toluene | 16.6 |
| 7 | AIBN | 0.17 |

The preparation and analysis of the particles was carried out in a manner analogous to that of PE-1 with the following exceptions. The emulsification was carried out using a Silverson Mixer for 10 minutes followed by sonication using a Vibra Cell probe sonicator (Sonics & Materials Inc.) at the highest power setting for 7 minutes. The dispersion was cooled in an ice bath during sonication to avoid initiation of the polymerization. The toluene was removed by heating the dispersion at 90° C. for 4 hours with nitrogen bubbling. In addition, the particles were not diafiltered. The product dispersion was found to have 10.15 wt % solids. Particle size analysis showed a bimodal distribution with a mean particle size of 0.19 micrometers. Analysis of the particles by electron microscopy showed wrinkled, irregularity shaped particles and wrinkled bowl-shaped particles.

Preparation of Polyester Dispersion PE-6

TABLE 10

| Component | Reagent | Amount (g) |
|---|---|---|
| 1 | Precursor Polyester PP-4 | 10.0 |
| 2 | Water | 205.0 |
| 3 | Styrene | 5.3 |
| 4 | Divinylbenzene | 1.3 |
| 5 | n-hexadecane | 0.17 |
| 6 | Toluene | 16.6 |
| 7 | AIBN | 0.17 |

The preparation and analysis of the particles was carried out in a manner identical to that of PE-5 except that propyl acetate was used in lieu of toluene. The product dispersion was found to have 9.90 wt % solids. Particle sizf analysis showed a mean particle size of 0.15 micrometers with a tail extending out to 0.8 micrometers. Analysis of the particles by electron microscopy showed wrinkled, irregularly shaped particles and wrinkled bowl-shaped particles.

Example 1

Preparation of Element 1

A coating composition was prepared from 77.6 wt. % of dispersion PE-1, 2.0 wt. % poly(vinyl alcohol), PVA, (Gohsenol® GH-17 from Nippon Gohsei Co.), and 20.4 wt. % water. [The relative proportions of wrinkled polyester particle to PVA are therefore 85/15 by weight]. The solution was coated onto a base support comprised of a polyethylene resin coated photographic paper stock, which had been previously subjected to corona discharge treatment, using a calibrated coating knife, and dried to remove substantially all solvent components to form the ink receiving layer. The thickness of the dry ink receiving layer was measured to be about 14±2 μm.

Preparation of Element 2

A coating composition was prepared from 14.9 wt. % of solid polyester particles PE-2, 2.6 wt. % poly(vinyl alcohol), PVA, (Gohsenol® GH-17 from Nippon Gohsei Co.), and 82.5 wt. % water. [The relative proportions of wrinkled polyester particle to PVA are therefore 85/15 by weight]. The solution was coated onto a base support comprised of a polyethylene resin coated photographic paper stock, which had been previously subjected to corona discharge treatment, using a calibrated coating knife, and dried to remove substantially all solvent components to form the ink receiving layer. The thickness of the dry ink receiving layer was measured to be about 40±2 μm.

Preparation of Element 3

A coating composition was prepared from 79.0 wt. % of dispersion PE-3, 1.8 wt. % poly(vinyl alcohol), PVA, (Gohsenol® GH-17 from Nippon Gohsei Co.), and 19.2 wt. % water. [The relative proportions of wrinkled polyester particle to PVA are therefore 85/15 by weight]. The solution was coated onto a base support comprised of a polyethylene resin coated photographic paper stock, which had been previously subjected to corona discharge treatment, using a calibrated coating knife, and dried to remove substantially all solvent components to form the ink receiving layer. The thickness of the dry ink receiving layer was measured to be about 10±2 μm.

Preparation of Element 4

A coating composition was prepared from 53.0 wt. % of dispersion PE-4, 1.8 wt. % poly(vinyl alcohol), PVA, (Gohsenol® GH-17 from Nippon Gohsei Co.), and 45.2 wt. % water. [The relative proportions of wrinkled polyester particle to PVA are therefore 85/15 by weight]. The solution was coated onto a base support comprised of a polyethylene resin coated photographic paper stock, which had been previously subjected to corona discharge treatment, using a calibrated coating knife, and dried to remove substantially all solvent components to form the ink receiving layer. The thickness of the dry ink receiving layer was measured to be about 10±2 μm.

Preparation of Element 5

A coating composition was prepared from 71.0 wt. % of dispersion PE-5, 1.8 wt. % poly(vinyl alcohol), PVA, (Gohsenol® GH-23 from Nippon Gohsei Co.), and 27.2 wt. % water. [The relative proportions of wrinkled polyester particle to PVA are therefore 80/20 by weight]. The solution was coated onto a base support comprised of a polyethylene resin coated photographic paper stock, which had been previously subjected to corona discharge treatment, using a calibrated coating knife, and dried to remove substantially all solvent components to form the ink receiving layer.

Preparation of Element 6

A Coating composition was prepared from 81.8 wt. % of dispersion PE-5, 0.9 wt. % poly(vinyl alcohol), PVA, (Gohsenol® GH-23 from Nippon Gohsei Co.), and 17.3 wt. % water. [The relative proportions of wrinkled polyester particle to PVA are therefore 90/10 by weight]. The solution was coated onto a base support comprised of a polyethylene resin coated photographic paper stock, which had been previously subjected to corona discharge treatment, using a calibrated coating knife, and dried to remove substantially all solvent components to form the ink receiving layer. The thickness of the dry ink receiving layer was measured to be about ±2 μm.

Preparation of Element 7

A coating composition was prepared from 77.8 wt. % of dispersion PE-6, 1.3 wt. % poly(vinyl alcohol), PVA, (Gohsenol® GH-23 from Nippon Gohsei Co.), and 20.9 wt. % water. [The relative proportions of wrinkled polyester particle to PVA are therefore 85/15 by weight]. The solution was coated onto a base support comprised of a polyethylene resin coated photographic paper stock, which had been previously subjected to corona discharge treatment, using a calibrated coating knife, and dried to remove substantially all solvent components to form the ink receiving layer.

Preparation of Control Element C-1

Control Element C-1 was a commercially available inkjet porous receiver paper containing a high amount of silica fine particles, "Epson Premium Glossy Photo Paper", Catalogue No. SO41286 from Epson.

Preparation of Control Element C-2

A coating solution (Solution S-1) was prepared by combining fumed alumina (Cab-O-Sperse® PG003, Cabot Corp.), poly(vinyl alcohol) (Gohsenol®) GH-23A, Nippon Gohsei Co., Ltd.) and 2,3-dihydroxy-1,4-dioxane (Clariant Corp.) in a weight ratio of 88:10:2 to give an aqueous coating formulation of 30% solids by weight.

A coating solution (Solution S-2) was prepared by combining fumed alumina (Cab-O-Sperse®D PG003, Cabot Corp.), poly(vinyl alcohol) (Gohsenol® GH-23A, Nippon Gohsei Co.) and a copolymer of (vinylbenzyl) trimethylammonium chloride and divinylbenzene (87:13 molar ratio) in a weight ratio of 85:3:12 to give an aqueous coating formulation of 10% solids by weight. The fumed alumina particles have a primary particle size of from about 7 to about 40 nm in diameter and are aggregated up to about 150 nm. Surfactants Zonyl® FSN (E. I. du Pont de Nemours and Co.) and Olin® 10G (Dixie Chemical Co.) were added in small amounts as coating aids.

Both solutions were metered to a multiple-slot-die coating apparatus and coated simultaneously at 40° C., with Solution S-1 being located below (closer to the support than) Solution S-2, onto a base support comprised of a polyethylene-coated paper base which had been previously subjected to corona discharge treatment. The coated support immediately entered the drying section of the coating machine to remove substantially all solvent components and form a two-layer image receiving element. The thicknesses of the bottom and topmost layers were 40 μm and 2 μm, respectively.

Printing and Dye Stability Testing

The above elements and control elements of Example 1 were printed using a Lexmark Z51 inkjet printer and a cyan inkjet ink, prepared using a standard formulation with a copper phthalocyanine dye (Clariant Direct Turquoise Blue FRL-SF), and a magenta ink, prepared using a standard formulation with Dye 6 from U.S. Pat. No. 6,001,161. The red channel density (cyan) patches and green channel density (magenta) patches at D-max (the highest density setting) were read using an X-Rite® 820 densitometer. The printed elements were then subjected to 4 days exposure to a nitrogen flow containing 5 ppm ozone. The density of each patch was read after the exposure test using an X-Rite® 820 densitometer. The % dye retention was calculated as the ratio of the density after the exposure test to the density before the exposure test. The results for cyan and magenta D-max are reported in Table 11.

TABLE 11

| Element | Cyan D-max | % dye retention cyan D-max | Magenta D-max | % dye retention magenta D-max |
|---|---|---|---|---|
| 1 | 1.9 | 95 | 2.0 | 99 |
| 2 | 1.58 | 97 | 1.58 | 86 |
| 3 | 1.3 | 88 | 1.5 | 99 |
| 4 | 1.6 | 96 | 2.5 | 97 |
| 5 | 2.1 | 100 | 1.6 | 98 |
| 6 | 2.3 | 92 | I.8 | 89 |
| 7 | 2.3 | 97 | 1.7 | 93 |
| C-1 | 2.1 | 20 | 2.3 | 3 |
| C-2 | 1.9 | 20 | 1.9 | 5 |

The above results show that improved dye stability for the element can be achieved when at least one layer of the element is an ink receiving layer capable of accepting an inkjet image that contains wrinkled polyestercontaining particles.

Example 2

Preparation of Element 8

A coating composition was prepared from 83.8 wt. % of dispersion PE-5, 1.5 wt. % poly(vinyl alcohol), PVA, (Gohsenol® GH-23 from Nippon Gohsei Co.), and 14.7 wt. % water. [The relative proportions of wrinkled polyester particle to PVA are therefore 85/15 by weight]. The solution was coated onto a base support comprised of a polyethylene resin coated photographic paper stock; which had been previously subjected to corona discharge treatment, using a calibrated coating knife, and dried to remove substantially all solvent components to form the ink receiving layer.

Preparation of Element 9

A coating composition was prepared from 85.0 wt. % of dispersion PE-6, 1.5 wt. % poly(vinyl alcohol), PVA, (Gohsenol® GH-23 from Nippon Gohsei Co.), and 13.5 wt. % water. [The relative proportions of wrinkled polyester particle to PVA are therefore 85/15 by weight]. The solution was coated onto a base support comprised of a polyethylene resin coated photographic paper stock, which had been previously subjected to corona discharge treatment, using a calibrated coating knife, and dried to remove substantially all solvent components to form the ink receiving layer.

Printing and Dye Stability Testing

The above elements and control elements of Example 2 and the control element C-1 from Example 1 were printed using a Lexmark Z51 inkjet printer. A cyan inkjet ink was prepared using a standard formulation with a cyan dye (Astra Blue 6GLL from Bayer), and lactic acid was added to protonate the dyes. A magenta ink was prepared using a standard formulation with Dye 12 from U.S. Ser. No. 09/643,281 filed Aug. 22, 2000 of Shuttleworth et al. The red channel density (cyan) patches and green channel density (magenta) patches at D-max (the highest density setting) were read using an X-Rite® 820 densitometer. The printed elements were then subjected to 4 days exposure to a nitrogen flow containing 5 ppm ozone. The density of each patch was read after the exposure test using an X-Rite® 820 densitometer. The % dye retention was calculated as the ratio of the density after the exposure test to the density before the exposure test. The results for cyan and magenta D-max are reported in Table 12.

TABLE 12

| Element | Cyan D-max | % dye retention cyan D-max | Magenta D-max | % dye retention magenta D-max |
|---|---|---|---|---|
| 8 | 2.2 | 83 | 2.0 | 96 |
| 9 | 2.1 | 85 | 2.3 | 93 |
| C-1 | 20 | 67 | 2.2 | 4 |

The above results show that improved dye stability for the element can be achieved when at least one layer of the element is an ink receiving layer capable of accepting an inkjet image that contains wrinkled polyester-ontaining particles.

The invention has been described in detail with particular reference to certain preferred embodiments thereof, but it will be understood that variations and modifications can be effected within the spirit and scope of the invention.

What is claimed is:

1. An ink recording element comprising a support and an ink receiving layer, wherein said ink receiving layer comprises at least one layer comprising particles having surfaces comprising at least one wrinkle.

2. The ink recording element of claim of claim 1 wherein the mean diameter of said wrinkled particles is less than 10 micrometers.

3. The ink recording element of claim 1 wherein said wrinkled particles have a mean diameter range between 0.1 and 5 micrometers.

4. The ink recording element of claim 1 wherein said wrinkled particles are surfactant stabilized.

5. The ink recording element of claim 1 wherein said wrinkled particle is stabilized by a colloidal inorganic.

6. The ink recording element of claim 1 wherein said wrinkled particle is stabilized by a protective colloid.

7. The ink recording element of claim 1 wherein said wrinkled particle is essentially spherical in shape.

8. The ink recording element of claim 1 wherein said wrinkled particle is bowl shaped.

9. The ink recording element of claim 1 wherein said wrinkled particles further comprise the copolymerization product of at least one ethylenically unsaturated monomer.

10. The ink recording element of claim 9 wherein said at least one ethylenically unsaturated monomer selected from the group consisting of styrene, divinylbenzene, divinyl adipate and cyclohexanedimethanol divinyl ether.

11. The ink recording element of claim 1 wherein said wrinkled particles comprise particles having a mean diameter of less than 0.5 micrometers.

12. The ink recording element of claim 1 wherein said support comprises paper.

13. The ink recording element of claim 12 wherein said paper comprises a coated paper.

14. The ink recording element of claim 13 wherein said coated paper comprises a polyolefin-coated paper.

15. The ink recording element of claim 12 wherein said paper comprises a polyolefin-laminated paper.

16. The ink recording element of claim 1 wherein said support is transparent.

17. The ink recording element of claim 1 wherein said support comprises poly(ethylene terephthalate).

18. The ink recording element of claim 1 wherein said at least one layer further comprises a polymeric binder.

19. The ink recording element of claim 18 wherein said polymeric binder is an organic binder.

20. The ink recording element of claim 18 wherein said wrinkled particles comprise between 50 and 95% by weight of said at least one layer.

21. The ink recording element of claim 18 wherein said wrinkled particles comprise between 75 and 90% by weight of said at least one layer.

22. The ink recording element of claim 18 wherein said polymeric binder comprises poly(vinyl alcohol).

23. The ink recording element of claim 18 wherein said polymeric binder comprises sulfonated polyester.

24. The ink recording element of claim 18 wherein said polymeric binder comprises gelatin.

25. The ink recording element of claim 18 wherein said polymeric binder comprises water dispersible polyurethane.

26. The ink recording element of claim 1 wherein said ink receiving layer comprises more than one layer, and wherein said wrinkled particles are present in at least one layer below the topmost layer of said ink recording element.

27. The ink recording element of claim 1 wherein said ink receiving layer comprises more than one layer, and wherein said wrinkled particles are present in the topmost layer of said ink recording element.

28. The ink recording element of claim 27 wherein said ink recording element further comprises at least one layer below said topmost layer, said layer comprising organic or inorganic particles.

29. The ink recording element of claims 28 wherein said inorganic particles comprise silica, alumina, calcium carbonate, clay, or barium sulfate.

30. The ink recording element of claims 28 wherein said organic particles comprise styrene-butadiene latex, polyurethane latex, or an acrylic latex.

31. The ink recording element of claim 27 wherein said ink recording element further comprises at least one layer below said topmost layer, said layer comprising a swellable polymer.

32. The ink recording element of claims 31 wherein said swellable polymer comprises at least one member selected from the group consisting of gelatin, poly(vinyl alcohol), and a sulfonated polyester.

33. The ink recording element of claim 27 wherein said ink recording element comprises a topmost layer further comprising organic or inorganic particles having a mean diameter of less than 0.5 micrometers.

34. The ink recording element of claim 33 wherein said organic particles comprise latex particles.

35. The ink recording element of claim 34 wherein said latex particles comprise polymers derived from styrenic, acrylic, or methacrylic monomers.

36. The ink recording element of claim 33 wherein said organic particles comprise polyester-containing particles.

37. The ink recording element of claim 33 wherein said inorganic particles are selected from the group consisting of silicon dioxide, alumina, calcium carbonate, and barium sulfate particles.

38. The ink recording element of claim 33 wherein said topmost layer further comprises a binder polymer.

39. The ink recording element of claim 38 wherein said binder polymer is selected from at least one member of the group consisting of poly(vinyl alcohol), gelatin, sulfonated polyester, and water dispersible polyurethane.

40. The ink recording element of claim 26 wherein said topmost layer is substantially free of particles.

41. The ink recording element of claim 40 wherein said topmost layer comprises poly(vinyl alcohol).

42. The ink recording element of claim 40 wherein said topmost layer comprises hydrogel or an organic polymer.

43. The ink recording element of claim 27 wherein said topmost layer has a thickness of between 1 and 20 micrometers.

44. The ink recording element of claim 1 having a thickness of between 10 and 50 micrometers.

45. The ink recording element of claim 1 wherein said element is an inkjet recording element.

46. The ink recording element of claim 1 wherein said wrinkled particles comprise polyester-containing particles.

47. The ink recording element of claim 46 wherein said wrinkled polyester-containing particles are made from a precursor polyester.

48. The ink recording element of claim 47 wherein said precursor polyester further comprises a sulfonated monomer.

49. The ink recording element of claim 47 wherein said precursor polyester comprises at least one member of the group consisting of maleic, fumaric, itaconic, phenylenediacrylic, citraconic and mesaconic acid.

50. The ink recording element of claim 49 wherein said at least one precursor polyester comprises at least one organically soluble monomer wherein said at least one organically soluble monomer comprises a unifunctional monomer and a polyfunctional monomer.

51. The ink recording element of claim 50 wherein the unifunctional monomer comprises at least 60 weight percent of the total organically soluble monomer.

52. The ink recording element of claim 50 wherein said unifunctional monomer comprises at least one member selected from the group consisting of styrenics, acrylates, and methacrylates.

53. The ink recording element of claim 50 wherein said polyfunction monomer comprises at least one member selected from the group consisting of divinylbenzene isomers, ethylene glycol divinyl ether, divinyl adipate, cyclohexanedimethanol divinyl ether and ethylene glycol dimethacrylate.

54. The ink recording element of claim 46 wherein said wrinkled polyester-containing particles have an ionic group equivalent weight of between 600 and 6000 grams per mole of ionic unit.

55. The ink recording element of claim 46 wherein said wrinkled polyester-containing particles further comprise the copolymerization product of at least one ethylenically unsaturated monomer.

56. The ink recording element of claim 55 wherein said at least one ethylenically unsaturated monomer selected from the group consisting of styrene, divinylbenzene, divinyl adipate and cyclohexanedimethanol diviny) ether.

57. The ink recording element of claim 46 wherein said wrinkled polyester-containing particle has an acid number of at least 10 mg KOH/g.

58. The ink recording element of claim 46 wherein said wrinkled polyester-containing particles comprise between 50 and 95% by weight of said at least one layer.

59. The ink recording element of claim 46 wherein said wrinkled polyester-containing particles comprise between 75 and 90% by weight of said at least one layer.

60. A method of forming an ink print comprising providing an ink recording element comprising at least one ink receiving layer comprising wrinkled particles and printing on said ink recording element utilizing an ink printer.

* * * * *